United States Patent [19]

Okada et al.

[11] 4,098,184

[45] Jul. 4, 1978

[54] PRESSURE OPERATED FLEXIBLE TRANSFER MEMBER FOR SCREEN PRINTER

[75] Inventors: Eiichi Okada, Tsurugashima; Hiroo Ebisawa, Sayama; Masashi Honma, Kawagoe; Tadashi Murakami, Sayama, all of Japan

[73] Assignee: Honda Giken Kogyo Kabushiki Kaisha, Japan

[21] Appl. No.: 771,542

[22] Filed: Feb. 24, 1977

[30] Foreign Application Priority Data

Jan. 17, 1977 [JP] Japan ..... 52/2985

[51] Int. Cl.[2] ..... B41F 17/28; B41F 15/10

[52] U.S. Cl. ..... 101/41; 101/115; 101/379; 118/50

[58] Field of Search ..... 101/41, 42, 115, 126, 101/129, 426, 379, 211; 118/50

[56] References Cited

U.S. PATENT DOCUMENTS

| | | | |
|---|---|---|---|
| 2,519,661 | 8/1950 | Johnson | 101/41 X |
| 2,904,916 | 9/1959 | Stahmann | 101/41 X |
| 3,688,695 | 9/1972 | James | 101/426 X |
| 3,745,970 | 7/1973 | Scantlebury | 101/41 X |
| 3,868,901 | 3/1975 | Valiela | 101/41 |

*Primary Examiner*—Ronald E. Suter

*Attorney, Agent, or Firm*—Polster, Polster and Lucchesi

[57] ABSTRACT

A method for printing designs, patterns, characters, letters, and other desired images on an object having a convex or raised surface, wherein the images to be transferred onto the object is first carried on a flexible image carrier, then this flexible image carrying medium is disposed in a mutually opposed relationship with the object to be printed at a predetermined space interval provided therebetween, thereafter the flexible image carrying medium is caused to expand or bulge out toward the raised surface of the object to be printed by a fluid pressure to act on the flexible medium from one side thereof opposite to that where the image is carried, while controlling a degree of expansion of the flexible image carrying medium is controlled by a restrictive frame for the flexible image carrying medium to attain an intimate contact between the flexible image carrying medium and the object to be printed over the entire surface thereof.

3 Claims, 8 Drawing Figures

PRESSURE OPERATED FLEXIBLE TRANSFER MEMBER FOR SCREEN PRINTER

BACKGROUND OF THE INVENTION

1. Field of the Invention

The present invention relates to a printing method, and an apparatus for effecting such method. More particularly, the invention is concerned with a method for printing any desired images such as characters, letters, designs, patterns, and so forth on an object having a convex or raised surface, and an apparatus for use in such printing.

2. Description of Prior Art

From U.S. Pat. No. 3,756,165, it has already been known to transfer a picture image onto an object to be printed. The patented method comprises disposing a flexible membrane and a flexible carrier having thereon a picture image to be transferred in a mutually parallel and closed relationship, and then bulging out the flexible membrane like a balloon by an air pressure so as to cause the flexible carrier to intimately contact with the object, onto which raised surface the picture image is to printed, by the pressure exerted at the time of expansion of the flexible membrane.

While the above-mentioned printing method may be suitably adopted for printing an image onto an inner surface of an object having a relatively gentle concave surface such as, for example, dishes, plates, and the like, it is not suitable for printing on an outer surface of an object of a large size and having a steep convex or raised surface (or a three-dimensional curvature) such as, for example, a fuel tank of a motor-cycle or any other large-sized vessels or contains of such configuration. The reason for the inapplicability is that, in the case of causing the flexible carrier to intimately contact with a steep convex surface of a wide area by a pressure of expanded flexible membrane, the flexible carrier is stretched by expansion or bulging out of the flexible membrane at the foot of the convex surface to result in positional discrepancy in the image as transferred thereon, while there takes place not so remarkable discrepancy in the image as transferred onto the top portion of the convex surface. Also, according to the image printing onto the convex surface by the above-described method, there has been another problem such that no sufficient pressure for the image transfer cannot be obtained due to stretching of the fliexible membrane and the flexible image carrying medium.

SUMMARY OF THE INVENTION

In view of the above-described disadvantage and problem inherent in the known method of printing an image on a curved surface utilizing the flexible membrane and the flexible carrier, it is a primary object of the present invention to provide an effective method of printing an image onto an object of a relatively large size or surface area, and having a steep convex surface in such a manner that the image as transferred is clear, and free from any positional discrepancy. The printed image is also free from undesirable irregularity.

It is another object of the present invention to provide an improved method of printing an image onto an object, which is useful for general purposes, is capable of printing a clear image onto a convex surface of a relatively gentle inclination such as, for example, an outer peripheral surface of a vehicle frame, and is, moreover, capable of easily conforming to a situation where the planar shape of the convex surface of an object to be printed is varied.

It is further object of the present invention to provide an improved device for use in effecting the above-mentioned method of printing an image on an object having a steep convex or raised surface such as, for example, a frame of a motor-cycle.

According to the present invention, in one aspect thereof, there is provided a method for printing an image on a convex surface of an object to be printed, which comprises steps of arranging an image to be transferred, the image being carried on a flexible medium, and an object having a convex surface, on which surface the image is to be printed, in a mutually opposed relationship with a certain definite space interval provided between them; causing the flexible medium carrying thereon the image to be transferred to expand or bulge out toward the convex surface of the object, onto which the image is to be printed, by causing a fluid pressure to act on the flexible medium from one side thereof opposite to that where the image is carried, while controlling the degree of expansion of the flexible medium within a predetermined restrictive zone; and transferring the image carried on the flexible medium onto the convex surface of the object to be printed by causing the convex surface to initimately contact with the bulged surface of the flexible medium along its peripheral surface.

Further, according to the present invention, in another aspect thereof, there is provided an apparatus for printing an image on a convex surface of an object to be printed, which comprises in combination a hollow main body having a charging and discharging port for a pressurized fluid, and an opening; a flexible membrane to tightly seal the opening of the hollow main body; a restrictive frame to control a degree of expansion of the flexible membrane, the frame being disposed at the outer side of the flexible membrane; a flexible carrier disposed at the outer side of the restrictive frame with an image portion thereon to be transferred being faced externally; and a table for mounting thereon the object to be printed, the table being disposed in confrontation to the flexible carrier, and the object having a convex or raised surface, on which printing is to be effected.

There has thus been outlined rather broadly, the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception, upon which this disclosure is based, may be readily utilized as a basis for the designing of other structure for carrying out the several purposes of the invention. It is important therefore that the claims be regarded as including such equivalent constructions as do not depart from the spirit and scope of the invention.

BRIEF DESCRIPTION OF THE ACCOMPANYING DRAWING

Specific embodiments of the invention have been chosen for the purpose of the illustration and description, and are shown in the accompanying drawings, forming a part of the specification, in which.

Figure 4:
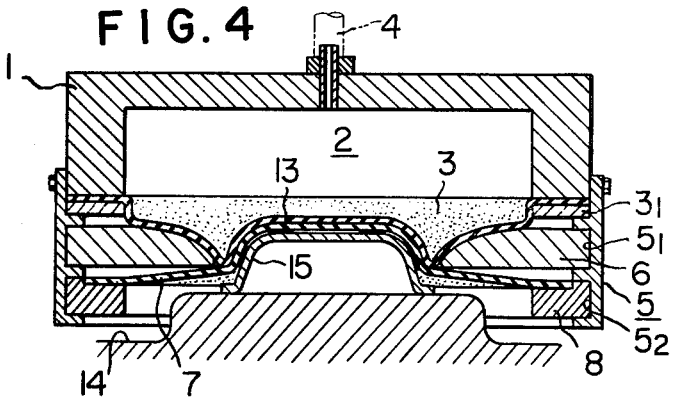
FIG. 4 is also a longitudinal cross-sectional view showing a state, in which the flexible image carrying member and an object to be printed have been intimately contacted.
Figure 7:
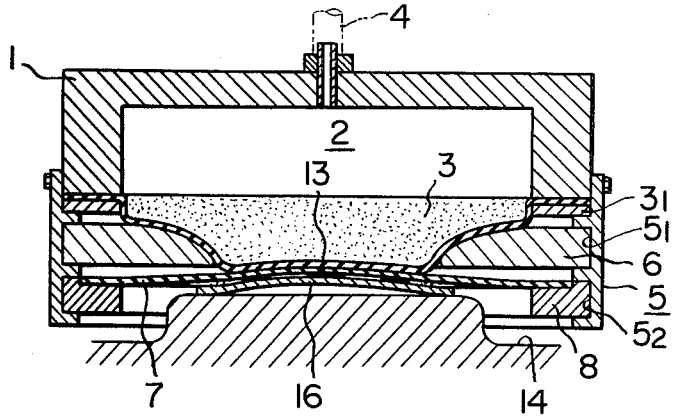
Figure 8:
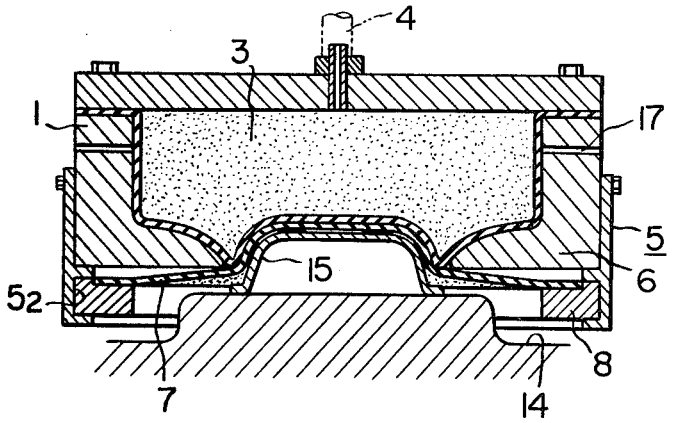

FIG. 7 is a longitudinal cross-sectional view of a modification of the present invention showing a state, in which the flexible carrier has been intimately contacted with an object to be printed as in FIG. 4; and FIG. 8 is a longitudinal cross-sectional view of another modification of the present invention showing a state, in which the flexible carrier has been intimately contacted with an object to be printed as in FIG. 4.

DETAILED DESCRIPTION OF PREFERRED EMBODIMENTS

In the following, the presenting invention will be explained in detail in reference to the preferred embodiments shown in FIGS. 2 to 8 of the accompanying drawing.

Figure 2:
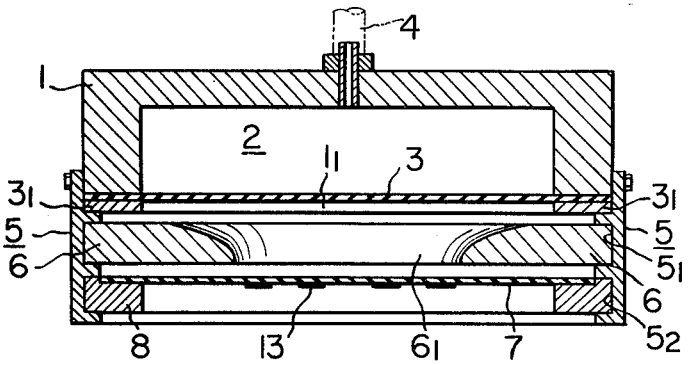
FIG. 2 is a longitudinal cross-sectional view of a printing apparatus according to the present invention.

Referring to FIG. 2 which shows one embodiment of the printing appratus for effecting the method of the present invention, a hollow main body 1 has an inner air tight chamber 2, an opening $1_1$ of which is tightly sealed with a flexible membrane 3 having a desired elasticity such as, for example, natural rubber, urethane rubber, and so forth. The flexible membrane 3 is exchangeable by removing a mounting frame $3_1$ from the main body 1. On the top surface of the hollow main body 1, there is provided a tube 4 which serves to charge and discharge air or like fluid in and out of the hollow main body 1. On the outer periphery of the main body 1 near the opening thereof, there is fitted a supporting frame 5. The supporting frame 5 is provided in its inner peripheral surface with a pair of guide grooves $5_1$ and $5_2$. A restrictive frame 6 to control a degree of expansion or bulging of the above-mentioned flexible membrane is held in the guide groove $5_1$ in a freely mountable and dismountable manner. An opening $6_1$ formed in the restrictive frame 6 is similar in shape to, and slightly larger in size than, the flat portion of the convex surface of the object, on which the image is to be printed.

Figure 1:
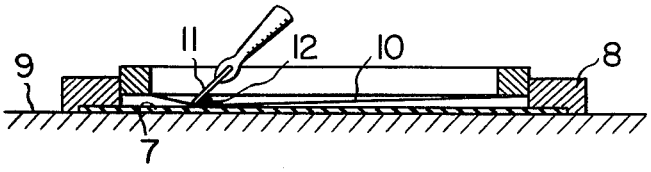
FIG. 1 is a longitudinal cross-sectional view showing a state, in which a picture image is to be printed on a flexible carrier.

The printing of the image on this convex surface of the object is carried out in the following manner:

(a) As shown in FIG. 1, a fixed frame 8, on the lower side of which there is extended a flexible carrier 7 having a good ink release and transfer property, is placed unmovably on a table 9. Subsequently, a screen 10 having thereon any desired picture images arranged at a certain definite space interval among them is set over this flexible image carrying member 7 by fittingly inserting the screen 10 on a frame into this fixed frame 8 from its upper side. Then, ink 12 on the top surface of the screen 10 is uniformly squeezed or scraped by a squeegee 11 to thereby transfer the image on the surface of the flexible carrier 7.

(b) As shown in FIG. 2, the fixed frame 8 holding the above-mentioned flexible carrier 7 is fitted into the guide groove $5_2$ formed in the inner peripheral surface of the supporting frame 5 fitted on the lower peripheral surface of the hollow main body 1 with the image carrying surface thereof being held downward.

Figure 3:
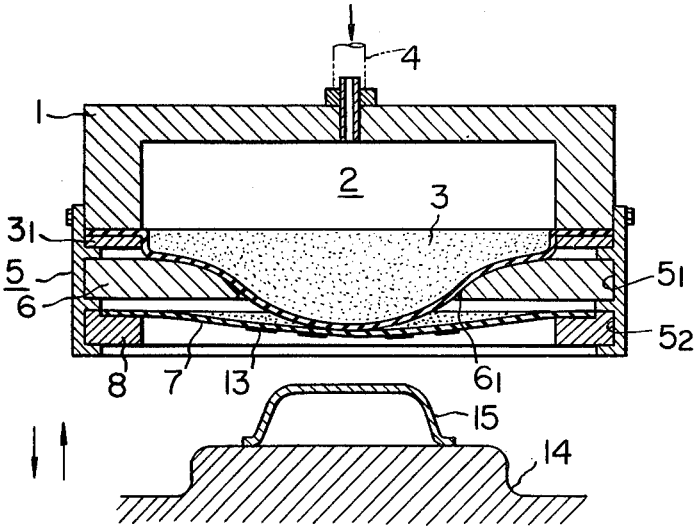
FIG. 3 is a longitudinal cross-sectional view showing a state, in which the flexible membrane has been expanded by a fluid pressure.

(c) As shown in FIG. 3, an object 15 having a convex surface of a steep inclination, on which the image carried on the flexible carrier 7 is to be printed, is fixedly placed on a mounting table 14 which is movable in the up-and-down direction by means of an air cylinder, a hydraulic cylinder, and so on, and is fixedly positioned in confrontation to the flexible carrier 7 with a certain definite space interval provided therebetween. Subsequently, air is charged into the air tight chamber 2 of the hollow main body through the fluid charging and discharging tube 4 to expand or bulge the flexible membrane 3 out of the opening $6_1$ to the restrictive frame 6, and, at the same time, the pressure in the air-tight chamber is maintained constant. The flexible image carrying member 7 is deflected toward the object by the flexible membrane as bulged out.

(d) Then, the mounting table 14 is raised upward to press the convex surface of the object 15 onto the image carrying surface of the flexible carrier 7 against the expansion pressure thereof until the flexible carrier 7 is pushed back inwardly of the hollow main body to form a concavity at the opening $6_1$ of the restrictive frame 6, thereby attaining an intimate contact between the flexible carrier 7 and the object 15, on which the printing is to be made.

Figure 5:
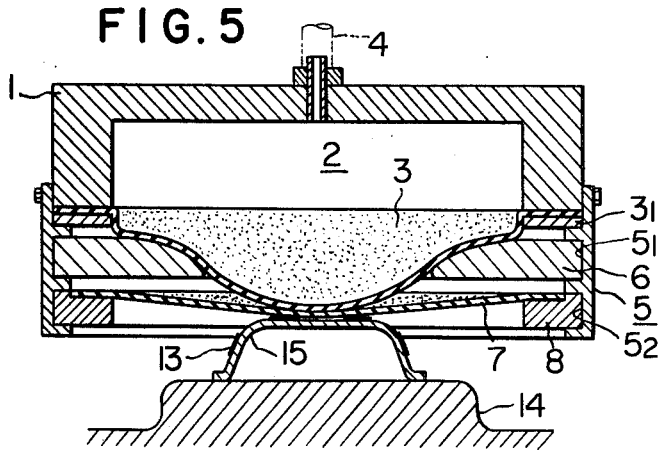
FIG. 5 is a longitudinal cross-sectional view showing a state, in which the flexible image carrying member is being separated from the object to be printed.

(e) As shown in FIG. 5, when the mounting table 14 is lowered, the image 13 carried by the flexible carrier 7 is released therefrom and transferred onto the convex surface of the object 15.

Figure 6:
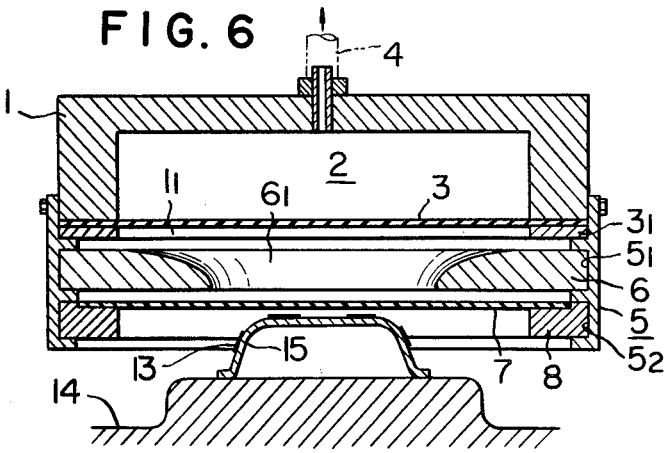
FIG. 6 is a longitudinal cross-sectional view showing a state, in which the printing operation has been completed.

(f) As shown in FIG. 6, when the fluid charging and discharging tube 4 is open to the atmosphere, the air within the air-tight chamber 2 of the hollow main body 1 is discharged from the chamber through the tube 4 by the restitutive force of the flexible membrane 3 and the flexible carrier 7, whereby both reinstate to their respective original positions and the subsequent printing cycle is made ready.

According to the present invention as described in the foregoing, since the flexible carrier 7 is expanded or bulged out by way of the flexible membrane 3, the outermost portion of the expanded flexible image carrying member 7 and the outermost portion of the convex surface of the object 15 contact each other closely at the commencement of the image transfer operation, thereafter both are gradually and intimately contacted toward the foot portion of the object 15, hence no cavitation of air takes place between the two members, and the irregularity in the printed image can be prevented in advance. On the other hand, when the flexible carrier is to be separated from the object at the completion of the image transfer operation, they are separated from the foot portion of the object toward its top portion, so that there is no possibility of the image as released from the flexible carrier and transferred onto the convex surface of the object being peeled off, and no failure in printing oeration takes place. Moreover, since the flexible carrier 7 becomes held between the flexible membrane 3 and the object 15 to be printed, and, at the same time, is intimately contacted with the object 15 to be printed by the preventive action of the opening $6_1$ of the restrictive frame 6 against expansion of the flexible membrane 3 as well as the squeezing action thereof, the elongation of the flexible image carrying member 7 is limited to the minimum extent, and an appropriate pressure for the image transfer resulted from such arrangement of the flexible membrane and the flexible image carrying member makes it possible to carry out the clear printing not only at the top portion of the convex surface of the object for printing, but also at the foot portion thereof.

Moreover, by making the abovementioned restrictive frame 6 freely insertable into and removable from the supporting frame 5, it is possible to use any appropriate shape of the restrictive frame commensurate with the planar shape of the convex surface of the object to be printed.

The present invention is also applicable to an object 16 having a very mild convexity as shown in FIG. 7. In addition, by making the flexible membrane and the restrictive frame freely attachable to and detachable from the main body, the maintenance of the device becomes advantageously easy.

In the afore-described embodiments, the mounting table 14 is movable in the up-and-down direction. Instead of moving the mounting table 14, however, the main body 1 is so designed as to be movable vertically, or both mounting table 14 and the main body 1 may be made movable up and down so that they may become close and away each other. Further, it should be noted that the pressure medium for expanding the flexible membrane is not limited to air, but any other fluid pressure medium such as water, oil and other hydraulic medium may be equally utilized. The printing of the image onto the flexible image carrying member is not limited to the screen printing, but a relief printing or a printing, in which the flexible carrier is expanded by a fluid pressure to cause the expanded flexible carrier to be press-contacted onto an engraved plate to thereby transfer the image, may be employed. Besides the above, it is also possible that a sheet having a picture image to be transferred is adhered to the flexible carrier. Furthermore, when printing is effected on a large number of objects of the same shape, no consideration needs be taken as to exchange of the restrictive frame 6, so that the portion of the restrictive frame 6 may be integrally formed with the main body as shown in FIG. 8. Incidentally, a reference numeral 17 in FIG. 8 designates an air-vent.

Finally, the printing method according to the present invention is capable of carrying out not only a monochromatic printing, but also a polychromatic or mulitcolor printing in a single stage of the printing process by forming in advance the image to be carried on the flexible image carrying member in a multi-colored condition.

What is claimed is:

1. An apparatus for printing an image on a convex surface of an object to be printed which comprises in combination:

a. a reciprocating hollow main body having a charging and discharging port for a pressurized fluid, and an opening;

b. a flexible membrane attached to said hollow main body to tightly seal the opening thereof;

c. a restrictive frame having an opening similar in shape to, and slightly larger in size than, a flat configuration of the convex surface of said object, said frame being mounted on said hollow main body at the outer side of said flexible membrane;

d. a flexible carrier mounted on said hollow main body at the outer side of said restrictive frame with an image portion thereon to be transferred being faced externally; and e. a fixed table for mounting the object disposed in confrontation to said flexible carrier, said object having a convex or raised surface, on which printing of the image is to be effected, said opening of said restrictive frame serving to control a degree of expansion of said flexible membrane, and to squeeze and intimately contact said flexible carrier with said object, when said object is inserted into said hollow main body through said opening of said restrictive frame at the time of printing.

2. The apparatus for printing an image on a convex surface of an object to be printed as set forth in claim 10, in which a supporting frame is provided on said main body near said opening thereof to support said restrictive frame and a flexible carrier in a freely mountable and dismountable manner.

3. The apparatus for printing an image on a convex surface of an object to be printed as set forth in claim 2, in which said supporting frame has a pair of grooves, one of which holds said restrictive frame, and the other of which holds a fixed frame of said flexible carrier.

* * * * *